US011314203B2

(12) United States Patent
Hirajima et al.

(10) Patent No.: US 11,314,203 B2
(45) Date of Patent: Apr. 26, 2022

(54) TECHNIQUE FOR COOLING HEATING ELEMENT PROVIDED IN IMAGE FORMING APPARATUS

(71) Applicant: CANON KABUSHIKI KAISHA, Tokyo (JP)

(72) Inventors: Marehiko Hirajima, Kanagawa (JP); Hiromi Fujinaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/368,923

(22) Filed: Jul. 7, 2021

(65) Prior Publication Data

US 2022/0011720 A1 Jan. 13, 2022

(30) Foreign Application Priority Data

Jul. 10, 2020 (JP) ..... JP2020-119447

(51) Int. Cl.

| | |
|---|---|
| ***G03G 21/20*** | (2006.01) |
| ***G03G 15/00*** | (2006.01) |
| ***G03G 15/20*** | (2006.01) |

(52) U.S. Cl.

CPC ..... *G03G 21/20* (2013.01); *G03G 15/205* (2013.01); *G03G 15/2039* (2013.01); *G03G 15/5004* (2013.01); *G03G 15/5012* (2013.01)

(58) Field of Classification Search

CPC ..... G03G 15/2039; G03G 15/205; G03G 15/5004; G03G 15/5012; G03G 21/20

See application file for complete search history.

(56) References Cited

U.S. PATENT DOCUMENTS

| | | | | |
|---|---|---|---|---|
| 8,224,197 | B2 | 7/2012 | Mohri | |
| 9,354,563 | B2 * | 5/2016 | Kirikubo | G03G 15/205 |
| 2012/0294640 | A1 * | 11/2012 | Arakawa | G03G 15/2017 399/69 |
| 2018/0267446 | A1 * | 9/2018 | Otsuka | G03G 15/2039 |

FOREIGN PATENT DOCUMENTS

| | | | |
|---|---|---|---|
| JP | 2007286579 | A | 11/2007 |
| JP | 2010134407 | A | 6/2010 |
| JP | 2010190976 | A | 9/2010 |
| JP | 2014157267 | A | 8/2014 |

* cited by examiner

*Primary Examiner* — Joseph S Wong

(74) *Attorney, Agent, or Firm* — Rossi, Kimms & McDowell LLP

(57) ABSTRACT

An image forming apparatus obtains an evaluation value correlating to an internal temperature, decreases the internal temperature by temporarily stopping an image forming unit based on the evaluation value, continuously runs the image forming unit based on the evaluation value, and controls the image forming unit such that the image forming unit intermittently forms an image on a sheet by repeatedly starting and stopping the image forming unit in a temperature rising suppression period.

21 Claims, 8 Drawing Sheets

FIG. 6

| ENVIRONMENTAL TEMPERATURE | LOW TEMPERATURE | NORMAL TEMPERATURE | HIGH TEMPERATURE |
|---|---|---|---|
| MAXIMUM VALUE OF DOWN TIME t tmax [min] | 1 | 3 | 5 |

FIG. 8A

| ENVIRONMENTAL TEMPERATURE | LOW TEMPERATURE | NORMAL TEMPERATURE | HIGH TEMPERATURE |
|---|---|---|---|
| MAXIMUM VALUE OF PRINT NUMBER Mmax | 30 | 20 | 10 |

FIG. 8B

| ENVIRONMENTAL TEMPERATURE | LOW TEMPERATURE | NORMAL TEMPERATURE | HIGH TEMPERATURE |
|---|---|---|---|
| MAXIMUM VALUE OF PRINT NUMBER Mmax | 30 | 20 | 10 |
| DOWN TIME t [min] | 1 | 3 | 5 |

TECHNIQUE FOR COOLING HEATING ELEMENT PROVIDED IN IMAGE FORMING APPARATUS

BACKGROUND OF THE INVENTION

Field of the Invention

The present invention relates to a technique for cooling a heating element provided in an image forming apparatus.

Description of the Related Art

When an image forming apparatus continuously forms a plurality of images, the internal temperature of the image forming apparatus rises. If images are continued to be formed while the internal temperature remains high, components of the image forming apparatus experience accelerated wear. According to Japanese Patent Laid-Open No. 2010-190976, when and end portion temperature of a fixing device reaches or goes above a predetermined value, the feeding interval is gradually increased while image formation is continued to decrease the end portion temperature. According to U.S. Pat. No. 8,224,197, when an internal temperature reaches or goes above a predetermined value, an image forming apparatus stops forming images.

In Japanese Patent Laid-Open No. 2010-190976, because the feeding interval is gradually increased, allowing image formation to be continued, the user can see that the image forming apparatus is operating normally. However, because image formation is continued, the temperature increase suppression effect is small. On the other hand, in U.S. Pat. No. 8,224,197, the image forming apparatus is completely stopped, giving it a high temperature increase suppression effect. However, because image formation is not restarted until the internal temperature sufficiently decreases, the user may think that the image forming apparatus is broken.

SUMMARY OF THE INVENTION

The present invention provides an image forming apparatus comprising: an image forming unit configured to form an image on a sheet; and a processor configured to obtain an evaluation value correlating to an internal temperature of the image forming apparatus, in a case where the evaluation value is equal to or greater than a first threshold, decrease the internal temperature by temporarily stopping the image forming unit, in a case where the evaluation value is less than the first threshold, continuously run the image forming unit, and control the image forming unit such that the image forming unit intermittently forms an image on a sheet by repeatedly starting and stopping the image forming unit in a temperature rising suppression period from when the evaluation value reaches a value equal to or greater than the first threshold to when the evaluation value returns to a value less than the first threshold.

Further features of the present invention will become apparent from the following description of exemplary embodiments (with reference to the attached drawings).

BRIEF DESCRIPTION OF THE DRAWINGS

FIG. 6 is a diagram for describing a table used in determining a maximum value for down time.

FIGS. 8A and 8B are diagrams for describing tables used in determining a maximum value for a print number.

DESCRIPTION OF THE EMBODIMENTS

Figure 1:
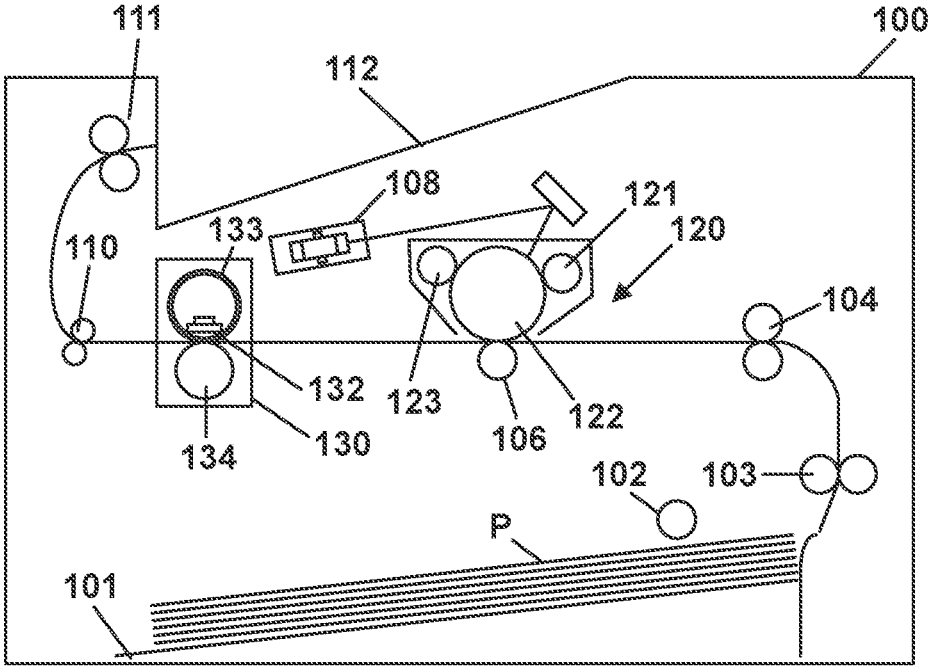
FIG. 1 is a diagram for describing an image forming apparatus.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

When an image forming apparatus continuously forms a plurality of images, the internal temperature of the image forming apparatus rises. When the internal temperature (evaluation value) of the image forming apparatus reaches or goes above a threshold, the image forming apparatus starts operating to suppress a rise in the internal temperature. In the art, during suppression operation, image formation is completely stopped. This may make the user think that the image forming apparatus is broken. In an example, during the temperature rising suppression period in which suppression operation is executed, image formation is intermittently (on and off) executed without completely stopping image formation. Thus, the user can see that image formation is being executed during the suppression period. This helps prevent the user from mistakenly thinking that the image forming apparatus is broken. Also, because image formation is intermittently executed, a rise in the internal temperature is appropriately suppressed.

Example 1

In Example 1, in the suppression period, image formation alternates between being executed and being stopped. This helps prevent the image forming apparatus from being mistakenly thought to be broken.

Image Forming Apparatus

An image forming device 100 is an electrophotography printer. A sheet cassette 101 is a housing case capable of housing a plurality of sheets P. A feeding roller 102 picks up sheets P from the sheet cassette 101 and sends them to a conveyance path. Conveyance rollers 103, 104 convey the sheets P to an image forming unit 120.

The image forming unit 120 including a photosensitive member 122, which is an image carrier that carries an electrostatic latent image and a toner image. A charging roller 123 uniformly charges the surface of the photosensitive member 122. An exposure device 108 forms an electrostatic latent image by irradiating the surface of the photosensitive member 122 with light in accordance with an image signal. A developing roller 121 develops the electrostatic latent image by attaching toner housed in a toner container to the electrostatic latent image and forms a toner image. A transfer roller 106 transfers the toner image from the photosensitive member 122 to the sheet P. A fixing device 130 includes a fixing film 133 and a pressing roller 134. A heater 132 abuts against the inner circumferential surface of the fixing film 133 and heats the fixing film 133. The pressing roller 134 is urged against the fixing film 133. This forms a fixing nip between the fixing film 133 and the pressing roller 134. When the sheet P passes the fixing nip, the fixing device 130 applies heat and pressure to the sheet P and the toner image. This fixes the toner image on the sheet P. The sheet P is conveyed by a conveyance roller 110 and a discharge roller 111 and discharged onto a discharge tray 112.

In this manner, a heat source such as a motor that drives the heater 132 and the rollers is provided inside the image forming device 100. Accordingly, when the image forming device 100 continuously forms a plurality of images, the internal temperature of the image forming device 100 rises. Internal temperature refers to the temperature of the internal space enclosed by the case of the image forming device 100. The outside air temperature (environmental temperature) of the image forming device 100 refers to the temperature outside of the case of the image forming device 100. In a case where the internal temperature is allowed to continue to rise, components of the image forming device 100 experience heavy wear. For example, the toner may stick in the toner container of the image forming unit 120. Thus, there is a need to appropriately suppress a rise in the internal temperature (temperature rising).

System Configuration of Image Forming Apparatus

Figure 2:
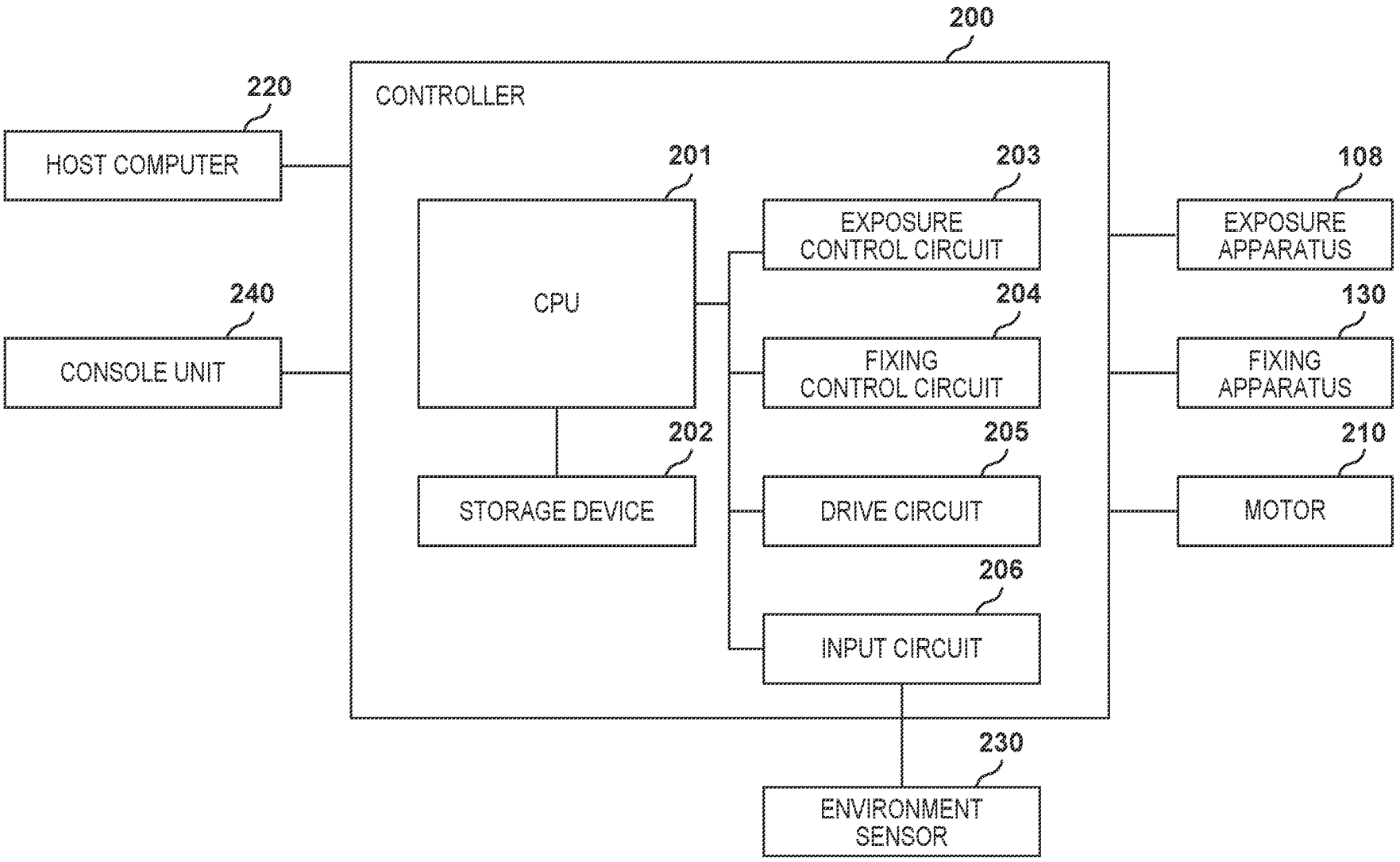
FIG. 2 is a diagram for describing a controller.

As illustrated in FIG. 2, the image forming device 100 includes a controller 200. The controller 200 may be divided into an image processing unit (printer controller) that processes image data and an engine controller that controls the image formation engine, such as the image forming unit 120 and the like. The controller 200 receives a print job from a host computer 220 and displays information on a display apparatus of a console unit 240. The controller 200 may receive an input of user instruction from an input apparatus of the console unit 240.

A CPU 201 is a central processing unit (processor) that is the core of the controller 200. Note that the CPU 201 may include a plurality of processor circuits. The CPU 201 controls the image forming device 100 according to a control program stored in a ROM area of a storage device 202. The storage device 202 may include a RAM area. The CPU 201 generates print reservation information for each sheet P based on a print job (printing conditions). The print reservation information, for example, includes the supply source (feeding cassette) of the sheet P, the size of the sheet P, the print mode, and the like. The print mode includes plain paper mode, thick paper mode, and the like. The CPU 201 converts the image data received from the host computer 220 or an image reader into exposure data and outputs the exposure data to an exposure control circuit 203. The exposure control circuit 203 controls the exposure device 108 according to the exposure data. The CPU 201 sets the print mode in a fixing control circuit 204. The fixing control circuit 204 controls the temperature of the heater 132 of the fixing device 130 according to the print mode. The CPU 201 controls a motor 210 via a drive circuit 205. The motor 210 drives rotary bodies, such as the photosensitive member 122, the conveyance rollers 103, 104, 110, and the like. An environment sensor 230 is a sensor that measures the outside air temperature of the image forming device 100. An input circuit 206 receives a detection signal of the environment sensor 230 and passes the detection signal to the CPU 201.

CPU Functions

Figure 3:
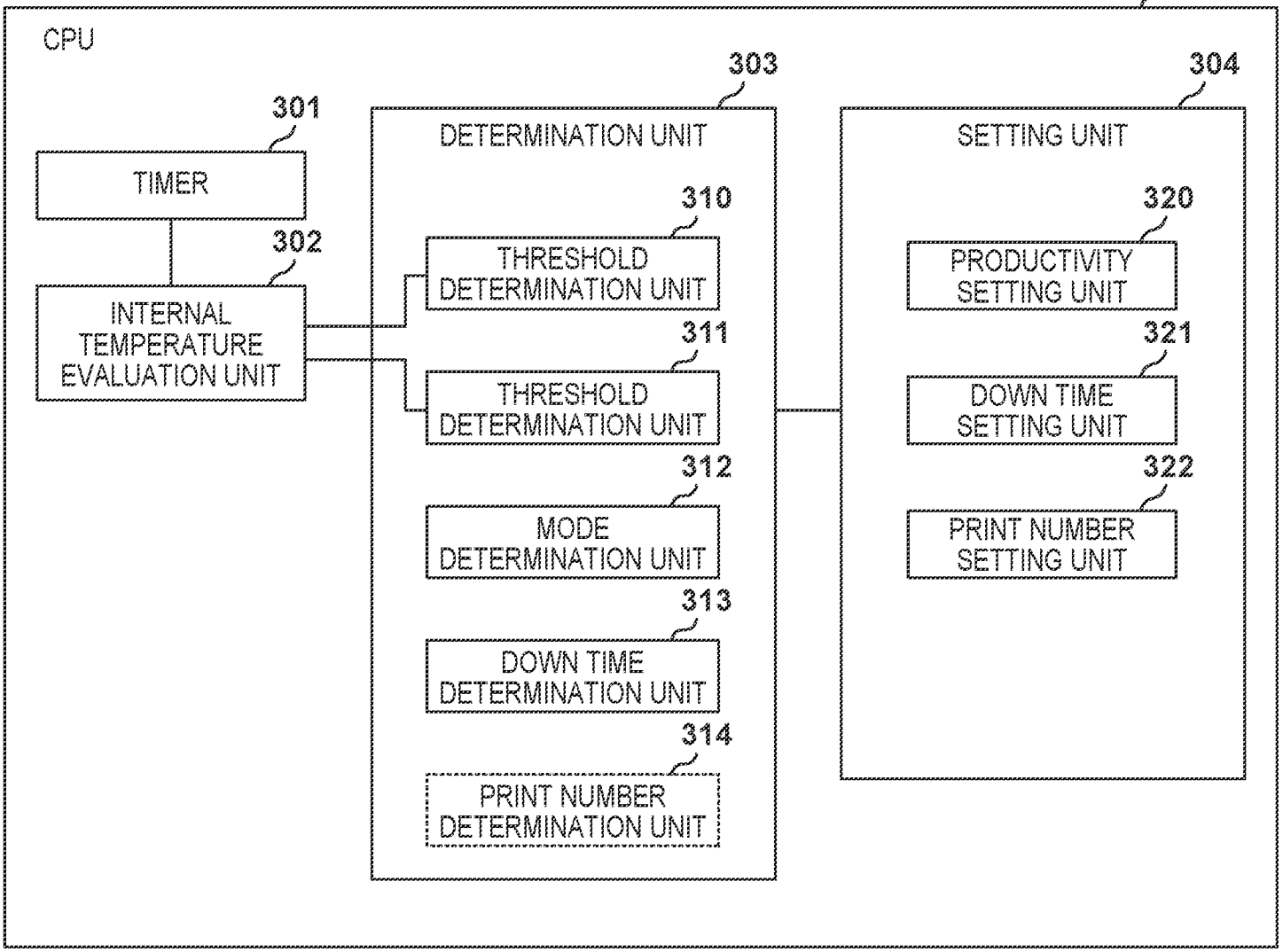
FIG. 3 is a diagram for describing functions of a CPU.

FIG. 3 is a diagram illustrating functions implemented by the CPU 201 according a control program. At least one of or all of the functions may be realized by a hardware circuit, such as a FPGA, an ASIC, or the like. FPGA stands for a field-programmable gate array. AISC stands for an application-specific integrated circuit.

A timer 301 measures the down time of the image forming device 100 and the continuous running time of the fixing device 130. An internal temperature evaluation unit 302 increases the evaluation value (also referred to as a counter) according to the continuous running time and decreases the evaluation value depending on the down time. The evaluation value is data correlating to the internal temperature, and thus may be converted to internal temperature. The evaluation value may be referred to as an internal temperature estimated value.

A determination unit 303 is a block that executes various determinations. A threshold determination unit 310 determines whether or not the evaluation value is equal to or less than a threshold TA. A threshold determination unit 311 determines whether or not the evaluation value is equal to or greater than a threshold TB. A mode determination unit 312 determines which productivity mode the operation mode of the image forming device 100 is set to. A down time determination unit 313 determines whether or not the down time is equal to or greater than a predetermined maximum value tmax. A print number determination unit 314 is used in Example 2 and executes determination relating to a print number M.

A setting unit 304 is a block that sets the operation mode, the threshold, the control value, and the like. A productivity setting unit 320, in a case where a rise in the internal temperature needs to be suppressed, determines the operation mode of the image forming device 100 on the basis of the evaluation value and/or the down time. The operation mode includes a first mode in which the print number per unit time is relatively high and a second mode in which the print number per unit time is relatively low. The print number may also be referred to as an image formation number. Note that the initial (default) operation mode is the first mode, which has higher productivity. A down time setting unit 321 sets the initial value (for example, a minimum value tmin) of a down time t, gradually increases the down time t, and sets the maximum value tmax of the down time t. The operation period for suppressing a rise in internal temperature (temperature rising suppression period) includes a plurality of control periods. The control periods include an image formation period (temporary restart period) and a stoppage period (down time). The image formation period and the stoppage period are alternately repeated. The image formation period and/or the stoppage period can have a variable length, and thus the length of the control period can also be varied. A print number setting unit 322 sets the print number for the image formation period to a fixed value and gradually reduces the print number setting unit 322.

Temperature Rising Suppression Period

Figure 4A:
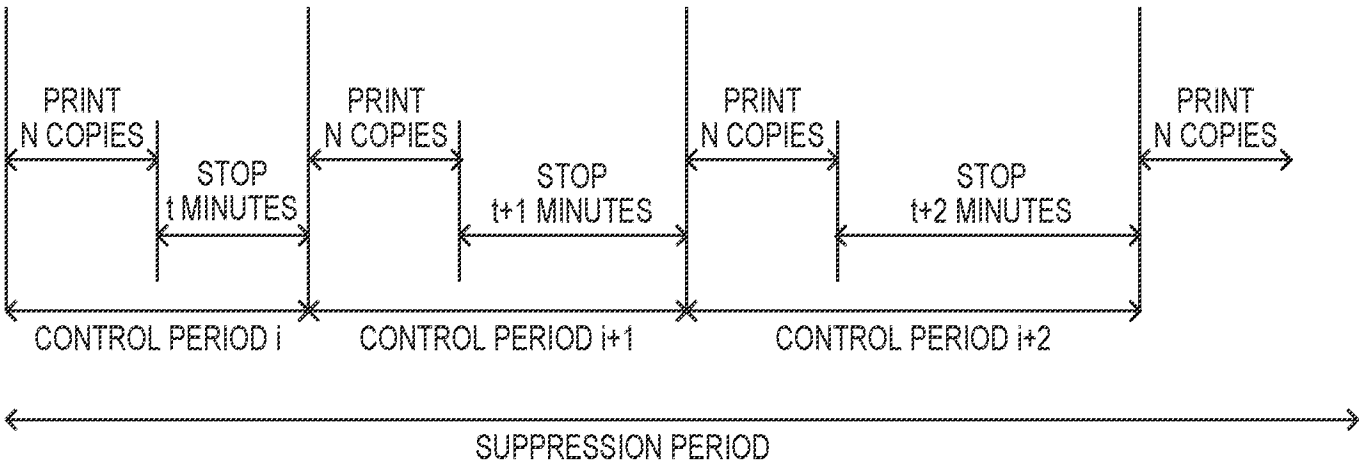
FIGS. 4A and 4B are diagrams for describing methods of reducing productivity.

FIG. 4A is a diagram illustrating an example of the temperature rising suppression period (hereinafter, shortened to suppression period) in which a rise in the internal temperature is suppressed according to Example 1. The suppression period includes a plurality of control periods. Note that the finish timing of the suppression period is not constant. The finish timing of the suppression period is when the internal temperature (evaluation value) has sufficiently decreased or when the print job is completed.

One control period includes an image formation period in which printing of N number of sheets is executed and a stoppage period in which no image formation is executed and the internal temperature is reduced. During the control period, the length (down time t) of the stoppage period is increased by one minute at a time. However, the print number in the image formation period remains a constant value even as the control period continues. In Example 1, because the down time t gradually increases, the control period gradually gets longer.

Flowchart

Figure 5:
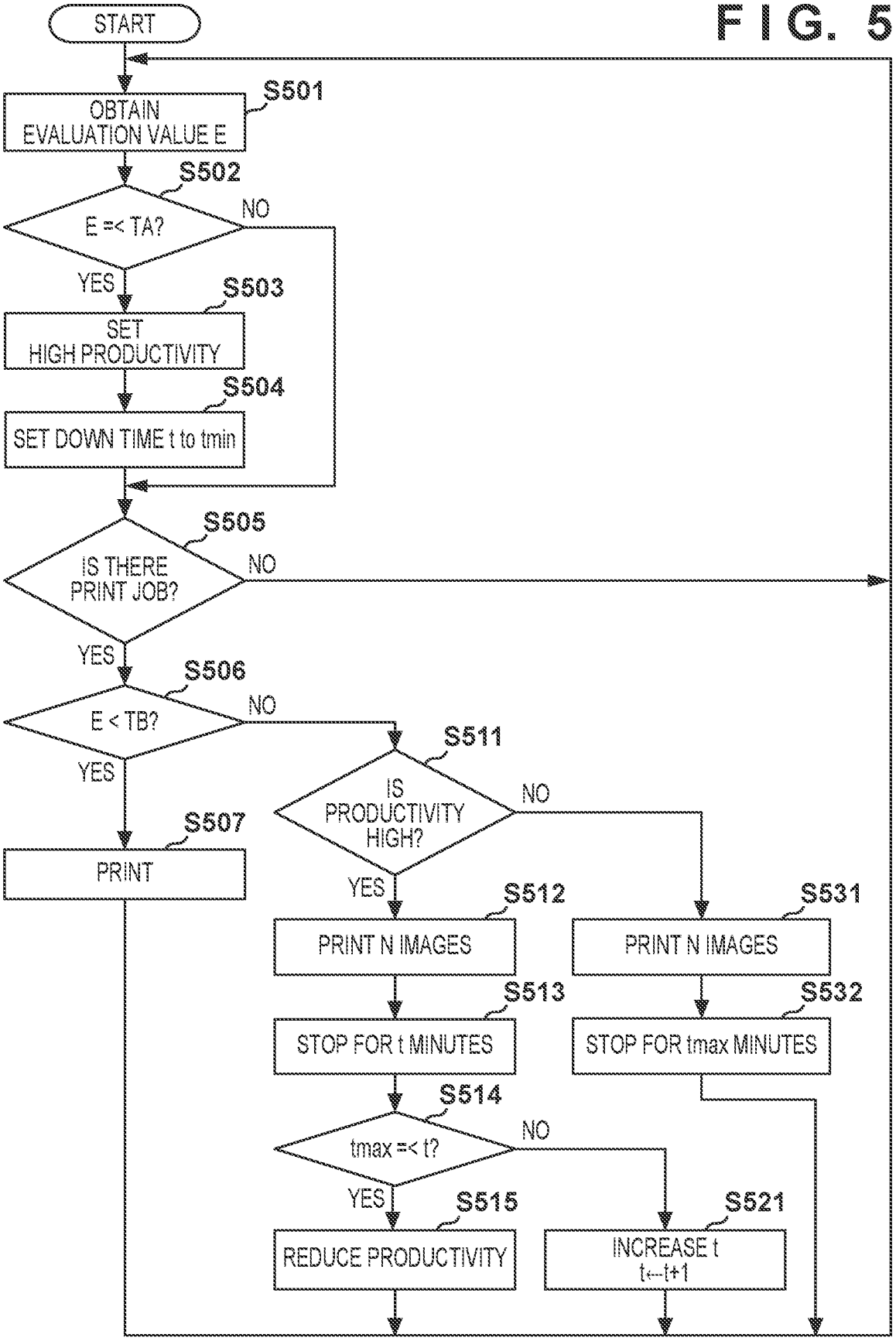
FIG. 5 is a flowchart illustrating image forming processing according to Example 1.

FIG. 5 is a flowchart illustrating the image formation control of Example 1. When power from a commercial AC power source is supplied to the image forming device 100 and the image forming device 100 is activated, the following process is executed by the CPU 201.

In step S501, the CPU 201 obtains an evaluation value E of the internal temperature. The internal temperature evaluation unit 302 determines the evaluation value E on the basis of the continuous image formation time and the continuous down time measured by the timer 301. For example, the storage device 202 may receive an input of a continuous image formation time x and a continuous down time y and stored an evaluation function f(x,y) for outputting the evaluation value E. In this case, the internal temperature evaluation unit 302 obtains the evaluation value E by the continuous image formation time x and the continuous down time y being input into the evaluation function f(x,y). Note that the evaluation function f(x,y) is determined in advance by experiment or simulation and is stored in the ROM area of the storage device 202.

In step S502, the CPU 201 (the threshold determination unit 310) determines whether or not the evaluation value E is equal to or less than the threshold TA. In a case where the evaluation value E is equal to or less than the threshold TA, the internal temperature is sufficiently low. However, in a case where the evaluation value E is above the threshold TA, the internal temperature is high enough to require the rise in internal temperature to be suppressed. In a case where the evaluation value E is equal to or less than the threshold TA, the CPU 201 proceeds to step S503. In a case where the evaluation value E is not equal to or less than the threshold TA, the CPU 201 proceeds to step S505. Note that the threshold TA corresponds to an evaluation value indicating a state in which the image forming device 100 is sufficiently cool and is determined by experiment or simulation and stored in the ROM area of the storage device 202.

In step S503, the CPU 201 (the productivity setting unit 320) sets the image forming device 100 to high productivity. For example, the productivity setting unit 320 sets the operation mode of the image forming device 100 to the first mode.

In step S504, the CPU 201 (the down time setting unit 321) sets the down time t of the suppression period in which a rise in internal temperature is suppressed to the minimum value tmin (for example, one minute). Note that the minimum value tmin is an example, and a lower value than the maximum value tmax from among values able to be set as the down time t may be set as the minimum value tmin.

In step S505, the CPU 201 (the determination unit 303) determines whether or not there is a print job. In a case where a print job has been input from the host computer 220 or the like, the CPU 201 proceeds to step S506. In a case where an input print job has already been completed, the CPU 201 also proceeds to step S506. In a case where there are not print jobs, the CPU 201 returns to step S501.

In step S506, the CPU 201 (the threshold determination unit 311) determines whether or not the evaluation value E is less than the threshold TB. In other words, the CPU 201 determines whether or not to start suppressing the rise in the internal temperature on the basis of the evaluation value E. In a case where the evaluation value E is less than the threshold TB, suppression of the rise in the internal temperature is not necessary. In this case, the CPU 201 proceeds to step S507. In step S507, the CPU 201 controls the image forming device 100 and forms an image on the sheet P in accordance with the print job. In a case where the evaluation value E is equal to or greater than the threshold TB, suppression of the rise in the internal temperature is necessary. In this case, the CPU 201 proceeds to step S511.

In step S511, the CPU 201 (the mode determination unit 312) determines whether or not the current productivity set for the image forming device 100 is high. For example, the mode determination unit 312 determines whether or not the operation mode set for the image forming device 100 is the first mode. In a case where the operation mode is the first mode, the CPU 201 proceeds to step S512. In a case where the operation mode is the second mode (or an operation mode with the lowest settable productivity), the CPU 201 proceeds to step S531. The productivity of the second mode is lower than the productivity of the first mode. In other words, the second mode is highly effective at suppressing the internal temperature. Note that between the first mode and the second mode, the conveyance speed of the sheet P may be the same, with the distance between the leading sheet P and the following sheet P being different. Alternatively, between the first mode and the second mode, the conveyance speed of the sheet P may be different, with the distance between the leading sheet P and the following sheet P being the same. In this manner, there are many ways to change the productivity of the first mode and the productivity of the second mode.

In step S512, the CPU 201 controls the image forming device 100 and prints an image on N number of sheets. N may be 10 sheets, for example. Note that in a case where an image is formed on both sides of one sheet, the print number is two. Also, in a case where an image is formed on a single side of one sheet, the print number is one.

In step S513, the CPU 201 stops the image forming device 100 for t minutes. In other words, fort minutes, the image forming device 100 does not form images. The heater 132 of the fixing device 130 is turned off, and the motor 210 is stopped. However, the motor 210 is stopped after the last sheet P on which an image is formed is discharged to the discharge tray 112. The rotation processing of the motor 210 for discharging the sheet P on which an image is formed may be referred to as post-rotation.

In step S514, the CPU 201 (the down time determination unit 313) determines whether or not the down time t is equal to or greater than a predetermined value (the maximum value tmax). The maximum value tmax is five minutes, for example. In a case where the down time t has reached the predetermined value (the maximum value tmax), there is a need to switch the operation mode and reduce productivity. In this case, the CPU 201 proceeds to step S515. In step S515, the CPU 201 (the productivity setting unit 320) reduces the productivity of the image forming device 100. For example, the productivity setting unit 320 switches the operation mode of the image forming unit from the first mode to the second mode. In a case where there are only two operation modes and the current operation mode is already the second mode, the operation mode remains as the second mode. In a case where there is a third mode with lower productivity than the second mode, the productivity setting unit 320 switches the operation mode from the second mode to the third mode. Then, the CPU 201 returns to step S501. However, in a case where the down time t has not reached the predetermined value (the maximum value tmax), the CPU 201 proceeds to step S521.

In step S515, the CPU 201 (the down time setting unit 321) increases the down time t. For example, the down time setting unit 321 adds a predetermined value (for example, one minute) to the current down time t. Then, the CPU 201 returns to step S501. In this manner, the down time t is gradually increased.

In step S531, the CPU 201 controls the image forming device 100 and prints an image on N number of sheets. In step S532, the CPU 201 stops the image forming device 100 for tmax minutes. In other words, for tmax minutes, the image forming device 100 does not form images. Then, the CPU 201 returns to step S501.

Note than once the suppression of the rise in the internal temperature has started, the down time t is maintained until the evaluation value E is equal to or less than the threshold TA. For example, in a case where a print job is completed with the down time t having increased to four minutes, the down time t is maintained at four minutes. Then, the process from step S501 to step S505 is repeated. Before the next print job is input, in a case where the evaluation value E is equal to or less than the threshold TA, the down time t is initialized. However, the evaluation value E may still be above the threshold TA when the next print job is input. In this case, the down time t is maintained at four minutes, and the process from step S506 onwards is executed.

FIG. 6 is a table used for determining the maximum value tmax of the down time t from the environmental temperature. This table can be stored in the ROM area of the storage device 202 and referenced by the CPU 201.

The CPU 201 (the down time setting unit 321) determines the maximum value tmax by referencing the table on the basis on the environmental temperature detected by the environment sensor 230. The down time setting unit 321 may divide the environmental temperature into a plurality of temperature levels. In a case where the detection result is high temperature, the down time setting unit 321 sets the maximum value tmax to five minutes. In a case where the detection result is normal temperature, the down time setting unit 321 determines the maximum value tmax to be three minutes. When continuous printing is executed in a state (E=<TA) in which the environmental temperature is normal temperature and the image forming device 100 is sufficiently cool, the internal temperature rises. When the internal temperature is greater than the predetermined temperature, suppression processing is started. In a first control period of the suppression processing, printing of N number of sheets (for example, ten sheets) and stoppage of the minimum value tmin minutes is executed. In a second control period, printing of N number of sheets (for example, ten sheets) and stoppage oft (=the minimum value tmin+1) minutes is executed. In a third control period, printing of N number of sheets (for example, ten sheets) and stoppage oft (=the minimum value tmin+2) minutes is executed. In a case where the detection result is low temperature, the down time setting unit 321 sets the maximum value tmax to one minute.

According to Example 1, when the internal temperature is equal to or greater than the predetermined temperature, suppression processing (suppression operation) to suppress the rise in the internal temperature is started. In the suppression processing, the productivity of the image forming device 100 is gradually decreased. Specifically, the print number in the image formation period is kept constant, but the length (down time t) of the stoppage period is gradually increased. In this manner, compared to known techniques that completely stop forming images in the suppression processing, instances of the user mistakenly thinking that the image forming device 100 is broken are reduced. Also, because images are intermittently formed in the suppression period, the productivity of the image forming device 100 is maintained. For example, take a case in which the suppression processing is started when the 99th sheet of a 100 sheet print job is completed. Also, take into account that in this case, five minutes is needed for the suppression processing to stop. With known techniques, the last single sheet is not printed until five minutes passes from the start of the suppression processing. However, with Example 1, the printing of the last sheet is completed during the suppression processing. Thus, compared to known techniques, the waiting time of the user is reduced. In this manner, according to Example 1, good productivity is maintained, and a rise in the internal temperature is appropriately suppressed.

Example 2

In Example 1, productivity is gradually reduced by gradually increasing the down time t without changing the print number. In Example 2, productivity is reduced by gradually reducing the print number without changing the down time t. Configurations and processes of Example 2 which are the same or similar to that of Example 1 are omitted from the following description.

Figure 4B:
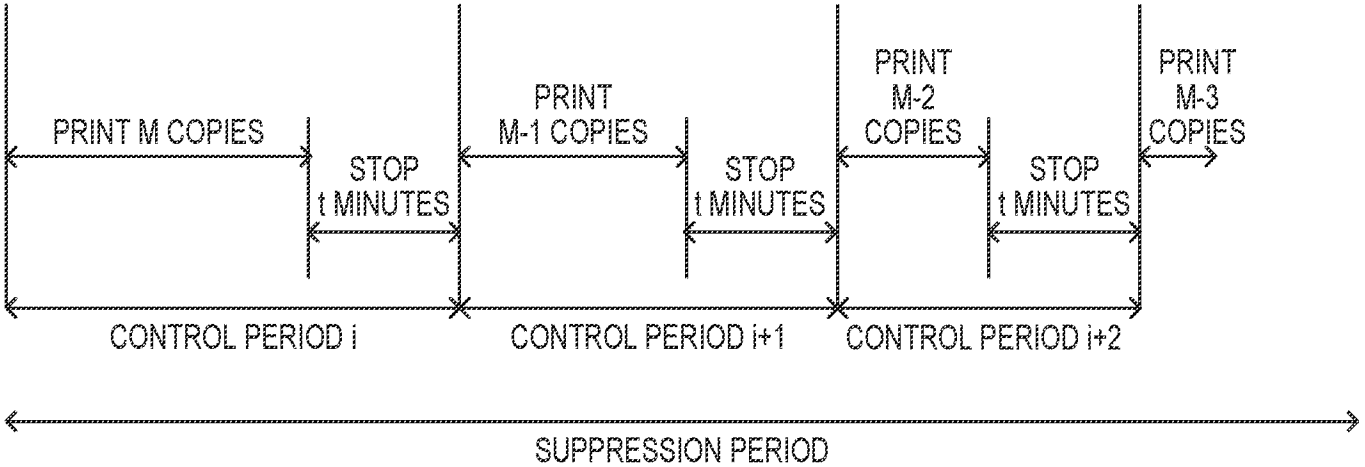

FIG. 4B is a diagram illustrating an example of the suppression period in which a rise in the internal temperature is suppressed according to Example 2. The suppression period includes a plurality of control periods.

One control period includes an image formation period in which printing is executed and a stoppage period in which no image formation is executed and the internal temperature is reduced. During the control period, the print number in the image formation period is reduced by one sheet at a time. However, the down time t remains a constant value even as the control period continues. In Example 2, because the print number is gradually decreased, the control period gradually gets shorter.

Figure 7:
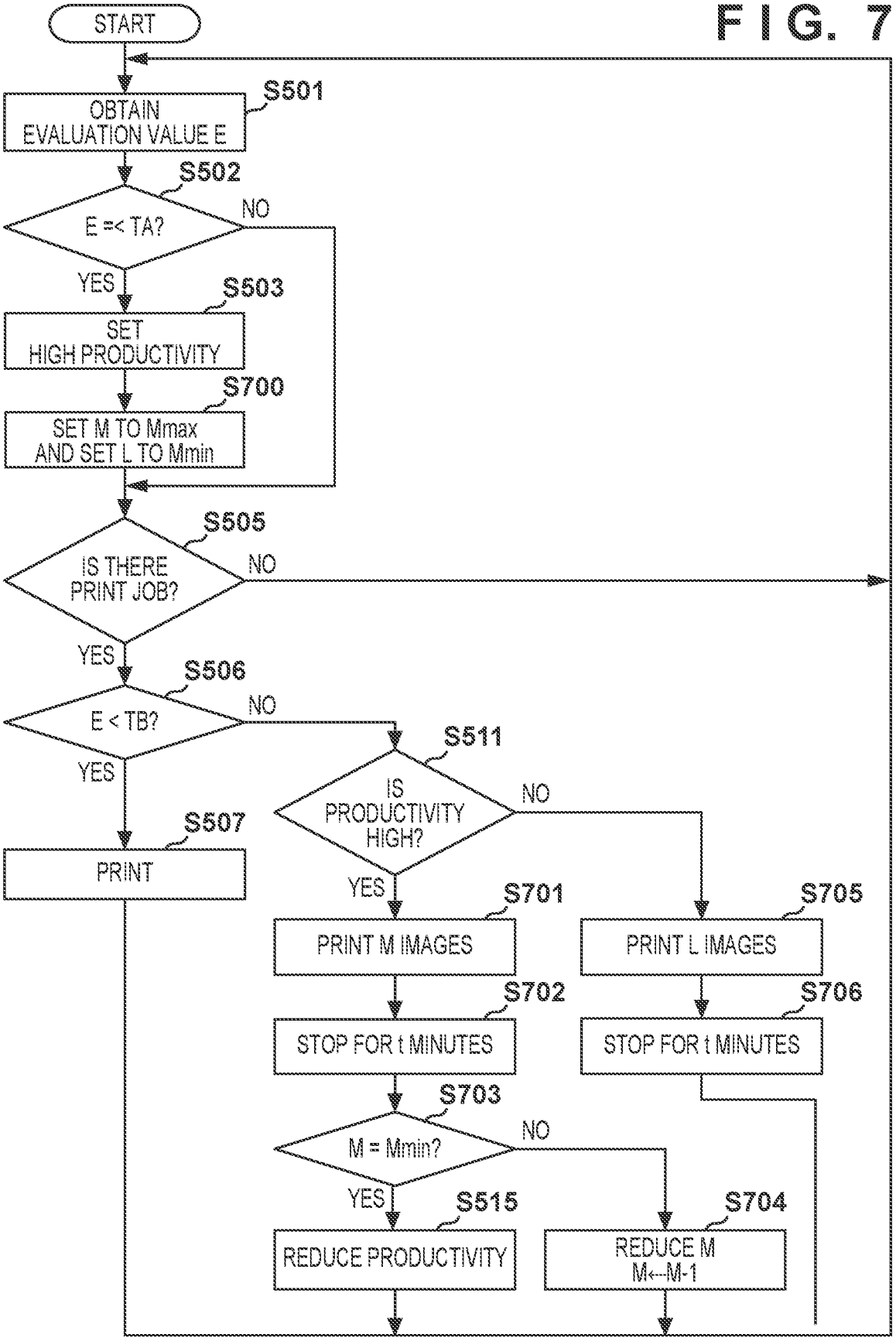
FIG. 7 is a flowchart illustrating image forming processing according to Example 2.

FIG. 7 is a flowchart illustrating the image forming processing according to Example 2. In FIG. 7, processes shared with FIG. 5 are given the same reference sign. Compared to FIG. 5, FIG. 7 includes steps S700 to S706.

Step S504 is replaced with step S700. In step S700, the CPU 201 (the print number setting unit 322) sets the print number M to a maximum value Mmax (for example, ten sheets) and sets a print number L to a minimum value Mmin (for example, one sheet). The print number M is a print number during the suppression processing when the operation mode is set to the first mode. The print number L is a print number during the suppression processing when the operation mode is set to the second mode.

In a case where the productivity is determined to be high (the operation mode is set to the first mode) in step S511, the CPU 201 proceeds to step S701. In step S701, the CPU 201 controls the image forming device 100 and prints M number of images on the sheets P. In step S702, the CPU 201 stops the image forming device 100 fort minutes. For example, the down time t is set to one minute. In this manner, the internal temperature is reduced. In step S703, the CPU 201 (the print number determination unit 314) determines whether or not the current print number M matches the minimum value Mmin. In a case where the current print number M matches the minimum value Mmin, the CPU 201 cannot reduce the print number M any more. Then, the CPU 201 proceeds to step S511. In step S511, the CPU 201 reduces the productivity by setting the operation mode to an operation mode (for example, the second mode) with a lower productivity in order to reduce the print number per unit time. In this manner, the effect of decreasing the internal temperature is increased. Then, the CPU 201 returns to step S501.

In step S703, in a case where the print number M does not match the minimum value Mmin, the CPU 201 proceeds to step S704. In step S704, the CPU 201 (the print number setting unit 322) reduces the print number M. For example, the print number M is reduced by one. In this example, the reduction value is one, but a reduction value of 2 or more may be used. Because the print number M in the image formation period is reduced, the effect of decreasing the internal temperature is increased. Then, the CPU 201 returns to step S501.

In a case where the productivity is determined to be low (the operation mode is set to the second mode) in step S511, the CPU 201 proceeds to step S705. In step S705, the CPU 201 controls the image forming device 100 and prints an image on L number of sheets. The print number L is set to the minimum value Mmin (for example, one sheet). In step S706, the CPU 201 stops the image forming device 100 fort minutes. Then, the CPU 201 returns to step S501.

According to Example 2, when the internal temperature is equal to or greater than the predetermined temperature, suppression processing to suppress the rise in the internal temperature is started. In the suppression processing, the productivity of the image forming device 100 is gradually decreased. Specifically, the print number in the image formation period is gradually reduced, but the length (down time t) of the stoppage period is kept constant. In this manner, compared to known techniques that completely stop forming images in the suppression processing, instances of the user mistakenly thinking that the image forming device 100 is broken are reduced. Also, because images are intermittently formed in the suppression period, the productivity of the image forming device 100 is maintained.

For example, the image forming device 100 forms images on ten sheets in the first control period and stops for one minute. The image forming device 100 forms images on nine sheets in the second control period and stops for one minute. The image forming device 100 forms images on eight sheets in the third control period and stops for one minute. The image forming device 100 forms an image on one sheet in the control periods after the tenth control period and stops for one minute. The CPU 201 holds the print number M of when the print job is completed in the RAM area without initializing the print number M. As illustrated in FIG. 7, when a new print job is input in a state in which the temperature is higher than a predetermined temperature, the print number M held in the RAM area is used. For example, in a case where the print number M is five, the image forming device 100 forms images on five sheets in the first control period and stops for one minute. The image forming device 100 forms images on four sheets in the second control period and stops for one minute.

FIG. 8A is a table used for determining the maximum value Mmax of the print number from the environmental temperature. This table can be stored in the ROM area of the storage device 202 and referenced by the CPU 201.

The CPU 201 (the print number setting unit 322) determines the maximum value Mmax by referencing the table on the basis on the environmental temperature detected by the environment sensor 230. The print number setting unit 322 may divide the environmental temperature into a plurality of temperature levels. For example, in a case where the detection result is high temperature, the print number setting unit 322 sets the maximum value Mmax to ten sheets. In a case where the detection result is normal temperature, the print number setting unit 322 sets the maximum value Mmax to 20 sheets. In a case where the detection result is low temperature, the print number setting unit 322 sets the maximum value Mmax to 30 sheets. The specific numerical value for the maximum value Mmax is determined via experiment or simulation and stored in the ROM area.

FIG. 8B is a table used for determining the maximum value Mmax of the print number and the down time t from the environmental temperature. This table can be stored in the ROM area of the storage device 202 and referenced by the CPU 201. As illustrated in FIG. 8B, the down time setting unit 321 may determine the maximum value Mmax and the down time t on the basis of the environmental temperature. In a case where the detection result is high temperature, the maximum value Mmax is set to ten sheets and the down time t is set to five minutes. In a case where the detection result is normal temperature, the maximum value Mmax is set to 20 sheets and the down time t is set to three minutes. In a case where the detection result is low temperature, the maximum value Mmax is set to 30 sheets and the down time t is set to one minute. In any of these cases, the higher the environmental temperature is, the more the productivity in the suppression period is reduced. Also, the lower the environmental temperature is, the more the productivity in the suppression period is increased.

Technical Ideas Derived from Examples

Perspective 1

As illustrated in FIG. 1, the image forming unit 120 is an example of an image forming unit that forms an image on a sheet. The CPU 201 (the internal temperature evaluation unit 302) is an example of an obtaining unit that obtains the evaluation value E correlating to the internal temperature of the image forming device 100. The controller 200 and the CPU 201 function as a control unit that controls the image forming unit. In a case where the evaluation value E is equal to or greater than a first threshold (for example, TA), the controller 200 and the CPU 201 stop the motor 210 and temporarily stop the image forming unit 120. This promotes a reduction in the internal temperature. When the evaluation value E returns to a value less than the first threshold, the controller 200 and the CPU 201 activate the motor 210 and continuously runs the image forming unit 120. Here, the operation period from the time when the evaluation value E reaches a value equal to or greater than the first threshold (for example, TA) to the time when the evaluation value E returns to a value less than the first threshold may be referred to as the temperature rising suppression period. In the temperature rising suppression period, images are intermittently formed on sheets by repeatedly starting and stopping the image forming unit 120. In other words, in the temperature rising suppression period, the image forming unit 120 is for the most part stopped, but is sometimes restarted to form an image. This makes it less likely for a user to mistakenly think that the image forming apparatus is broken and allows a rise in the internal temperature of the image forming device 100 to be appropriately suppressed. By appropriately suppressing a rise in the internal temperature, sticking of the toner, component wear, and the like are minimized or prevented.

Perspectives 2 to 4

As illustrated in FIG. 4A, the operation period (suppression period) may include a plurality of control periods. The plurality of control periods each include a first period and a second period. The first period is an image forming period in which the image forming unit continuously forms images on sheets. The second period is a stoppage period (suspension period) in which the image forming unit does not form images on sheets. As illustrated in FIG. 4A, the first period may be a time period with a constant length in which images are formed on a predetermined number of sheets (for example, N number of sheets). The second period may be a time period with a variable length that gradually increases in length for each control period. In this manner, productivity is gradually reduced. The print number is different depending on the print job. Also, the print job may be completed within the suppression period. Thus, by gradually reducing the productivity, the waiting time the user has to wait for the print job to be completed can be reduced. As indicated by step S514 and the like, when the second period reaches a predetermined maximum value (for example, tmax), the CPU 201 may fix the second period to the maximum value.

Perspectives 5 to 7

The CPU 201 may include the first mode in which the number of sheets an image is formed on per unit time is relatively high and a second mode in which the number of sheets an image is formed on per unit time is relatively low. In other words, the productivity of the first mode is higher than the productivity of the second mode. As indicated by step S515, when the second period reaches the maximum value, the CPU 201 may switch the operation mode from the first mode to the second mode. In this manner, after the down time t is increased to the limit, the print number per unit time may be reduced to achieve a further reduction in productivity.

When the evaluation value E is equal to or less than a second threshold (for example, TA), the CPU 201 may set the operation mode to the first mode. For example, when the internal temperature is sufficiently low, the operation mode may be set to the first mode, which has high productivity.

When the evaluation value E is equal to or less than the second threshold, the CPU 201 may return the length of the second period to the initial value (for example, the minimum value tmin). For example, when the internal temperature is sufficiently low, the down time t is initialized, increasing productivity.

Perspective 8

The environment sensor 230 is an example of a measuring unit that measures the outside air temperature of the image forming device 100. The down time setting unit 321 functions as a setting unit that sets the maximum value according to the outside air temperature measured by the measuring unit. As described using FIG. 6, depending on the environmental temperature, the margins for the internal temperature in relation to threshold temperatures are different. Thus, the higher the environmental temperature, the greater the maximum value tmax of the down time t.

Perspective 9

As described in Example 2 and illustrated in FIG. 4B, the first period may be a time period in which the image formation number (for example, the print number M) is gradually decreased in each control period. The second period may be a time period with a constant length. Accordingly, the productivity may be gradually reduced.

Perspectives 10 to 13

As indicated in steps S703 and S515, when the image formation number in the first period reaches the predetermined minimum value Mmin, the CPU 201 may fix the image formation number in the first period to the minimum value. When the image formation number in the first period reaches the minimum value, the CPU 201 may switch the operation mode of the image forming unit from the first mode to the second mode.

As indicated in step S503, when the evaluation value E is equal to or less than the second threshold (for example, TA), the CPU 201 may set the operation mode to the first mode. In this manner, productivity is improved. As indicated in step S700, when the evaluation value E is equal to or less than the second threshold, the CPU 201 may return the image formation number formed in the first period to the initial value (for example, the maximum value Mmax). In this manner, productivity is improved.

Perspectives 14 and 15

As illustrated in FIG. 8A, the print number setting unit 322 may set the initial value (for example, the maximum value Mmax) according to the outside air temperature measured by the measuring unit (for example, the environment sensor 230). Depending on the environmental temperature, the margins for the internal temperature in relation to threshold temperatures are different. Thus, the higher the environmental temperature, the more the maximum value Mmax of the print number M may be decreased. This promotes a reduction in the internal temperature. As illustrated in FIG. 8B, the down time setting unit 321 may set the length (for example, the down time t) of the second period according to the outside air temperature measured by the measuring unit. For example, the higher the environmental temperature, the greater the maximum value tmax of the down time t. This promotes a reduction in the internal temperature.

Perspective 16

In Example 2 also, an operation period (suppression period) from when the evaluation value reaches a value equal to or greater than the first threshold to the time when the evaluation value returns to a value less than the first threshold is set. During the suppression period, the operation mode of the image forming unit may be switched from the first mode to the second mode. In this case, the CPU 201 may fix the image formation number in the first period to a predetermined value (for example, the minimum value Mmin).

Perspective 17

The second threshold (for example, TA) is lower than the first threshold (for example, TB). This is because the second threshold (for example, TA) is a threshold used for determining if the internal temperature is sufficient low, and the first threshold (for example, TB) is a threshold used for determining whether or not a rise in the internal temperature needs to be suppressed.

Perspective 18

As indicated in steps S506 and S507, when the evaluation value E is less than the first threshold (for example, TB), the CPU 201 controls the image forming unit to continuously form images on sheets. Accordingly, the high productivity of the image forming device 100 is maintained, and the waiting time of the user is reduced.

Perspective 19

The temperature rising suppression period includes a plurality of temporary restart periods in which the image forming unit temporarily restarts forming images. The CPU 201 controls the image forming unit 120 and the like to gradually reduce the productivity of the image forming unit in each of the plurality of temporary restart periods. For example, the productivity in a following temporary restart period is lower than the productivity in a leading temporary restart period. In other words, in the temperature rising suppression period, the productivity of the image forming unit gradually decreases. This makes it less likely for a user to mistakenly think that the image forming apparatus is broken and allows a rise in the internal temperature of the image forming device 100 to be appropriately suppressed. By appropriately suppressing a rise in the internal temperature, sticking of the toner, component wear, and the like are minimized or prevented.

Perspectives 20 and 21

The CPU 201 may gradually reduce the productivity of the image forming unit in the operation period by gradually increasing the length of the second period each time the control period is repeated while fixing the image formation number in the first period (temporary restart period). The CPU 201 may gradually reduce the productivity of the image forming unit in the operation period by gradually decreasing the image formation number in the first period each time the control period is repeated while fixing the length of the second period.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-119447, filed Jul. 10, 2020 which is hereby incorporated by reference herein in its entirety.

What is claimed is:

1. An image forming apparatus comprising:

an image forming unit configured to form an image on a sheet; and a processor configured to obtain an evaluation value correlating to an internal temperature of the image forming apparatus, in a case where the evaluation value is equal to or greater than a first threshold, decrease the internal temperature by temporarily stopping the image forming unit, in a case where the evaluation value is less than the first threshold, continuously run the image forming unit, and control the image forming unit such that the image forming unit intermittently forms an image on a sheet by repeatedly starting and stopping the image forming unit in a temperature rising suppression period from when the evaluation value reaches a value equal to or greater than the first threshold to when the evaluation value returns to a value less than the first threshold.

2. The image forming apparatus according to claim 1, wherein the temperature rising suppression period includes a plurality of control periods; and the plurality of control periods each include a first period in which the image forming unit continuously forms an image on a sheet, and a second period in which the image forming unit does not form an image on a sheet.

3. The image forming apparatus according to claim 2, wherein the first period is a time period with a constant length in which an image is formed on a predetermined number of sheets; and the second period is time period with a variable length that gradually increases in length in each of the control periods.

4. The image forming apparatus according to claim 3, wherein in a case where the second period reaches a predetermined maximum value, the processor is configured to fix the second period to the maximum value.

5. The image forming apparatus according to claim 4, wherein the processor includes a first mode in which an image formation number per unit time is relatively high, and a second mode in which an image formation number per unit time is relatively low; and in a case where the second period reaches the maximum value, the processor is configured to switch an operation mode of the image forming unit from the first mode to the second mode.

6. The image forming apparatus according to claim 5, wherein in a case where the evaluation value is equal to or less than a second threshold, the processor is configured to set the operation mode to the first mode.

7. The image forming apparatus according to claim 6, wherein in a case where the evaluation value is equal to or less than the second threshold, the processor is configured to return a length of the second period to an initial value.

8. The image forming apparatus according to claim 4, further comprising:

a sensor configured to measure an outside air temperature of the image forming apparatus;

wherein the processor is configured to set the maximum value according to the outside air temperature measured by the sensor.

9. The image forming apparatus according to claim 2, wherein the first period is a time period in which an image formation number is gradually decreased in each of the control periods; and the second period is a time period with a constant length.

10. The image forming apparatus according to claim 9, wherein in a case where an image formation number in the first period reaches a predetermined minimum value, the processor is configured to fix the image formation number in the first period to the minimum value.

11. The image forming apparatus according to claim 10, wherein the processor includes a first mode in which an image formation number per unit time is relatively high, and a second mode in which an image formation number per unit time is relatively low; and in a case where the image formation number in the first period reaches the minimum value, the processor is configured to switch an operation mode of the image forming unit from the first mode to the second mode.

12. The image forming apparatus according to claim 11, wherein in a case where the evaluation value is equal to or less than a second threshold, the processor is configured to set the operation mode to the first mode.

13. The image forming apparatus according to claim 12, wherein in a case where the evaluation value is equal to or less than the second threshold, the processor is configured to return the image formation number in the first period to an initial value.

14. The image forming apparatus according to claim 13, further comprising:

a sensor configured to measure an outside air temperature of the image forming apparatus;

wherein the processor is configured to set the initial value according to the outside air temperature measured by the sensor.

15. The image forming apparatus according to claim 14, wherein the processor is configured to set a length of the second period according to the outside air temperature measured by the sensor.

16. The image forming apparatus according to claim 11, wherein the processor is configured to in a case where an operation mode of the image forming unit is switched from the first mode to the second mode in the temperature rising suppression period from when the evaluation value reaches a value equal to or greater than a first threshold to when the evaluation value returns to a value less than the first threshold, fix the image formation number in the first period to a predetermined value.

17. The image forming apparatus according to claim 6, wherein the second threshold is lower than the first threshold.

18. The image forming apparatus according to claim 1, wherein in a case where the evaluation value is less than the first threshold, the processor is configured to control the image forming unit to continuously form an image on a sheet.

19. An image forming apparatus comprising:

an image forming unit configured to form an image on a sheet; and a processor configured to obtain an evaluation value correlating to an internal temperature of the image forming apparatus, in a case where the evaluation value is equal to or greater than a first threshold, decrease the internal temperature by temporarily stopping the image forming unit, and in a case where the evaluation value is less than the first threshold, continuously run the image forming unit;

wherein a temperature rising suppression period from when the evaluation value reaches a value equal to or greater than the first threshold to when the evaluation value returns to a value less than the first threshold includes a plurality of temporary restart periods in which the image forming unit temporarily restarts forming images; and the processor is configured to control the image forming unit to gradually reduce productivity of the image forming unit in each of the plurality of temporary restart periods.

20. The image forming apparatus according to claim 19, wherein the temperature rising suppression period includes a plurality of control periods;

the plurality of control periods each include as the temporary restart period, a first period in which the image forming unit continuously forms an image on a sheet, and a second period in which the image forming unit does not form an image on a sheet; and the processor is configured to gradually reduce productivity of the image forming unit in the temperature rising suppression period by gradually increasing the second period while fixing an image formation number in the first period each time the control period is repeated.

21. The image forming apparatus according to claim 19, wherein the temperature rising suppression period includes a plurality of control periods;

the plurality of control periods each include as the temporary restart period, a first period in which the image forming unit continuously forms an image on a sheet, and a second period in which the image forming unit does not form an image on a sheet; and the processor is configured to gradually reduce productivity of the image forming unit in the temperature rising suppression period by gradually decreasing the image formation number in the first period while fixing a length of the second period each time the control period is repeated.

* * * * *